US007051911B2

(12) United States Patent
Lai et al.

(10) Patent No.: US 7,051,911 B2
(45) Date of Patent: May 30, 2006

(54) APPARATUS AND METHOD FOR CUTTING SHEET MATERIALS

(75) Inventors: Yeh-hung Lai, Webster, NY (US); Matthew N. Keene, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 513 days.

(21) Appl. No.: 10/037,017

(22) Filed: Dec. 21, 2001

(65) Prior Publication Data

US 2003/0131699 A1 Jul. 17, 2003

(51) Int. Cl.
*B26F 3/00* (2006.01)

(52) U.S. Cl. ..... 225/2; 225/94; 83/675

(58) Field of Classification Search ..... 225/103, 225/2, 94, 93, 96; 30/225, 284; 83/500, 83/675, 51, 496; 430/22, 496, 536, 538
See application file for complete search history.

(56) References Cited

U.S. PATENT DOCUMENTS

| | | | | | |
|---|---|---|---|---|---|
| 1,366,063 | A | * | 1/1921 | Culhane, Jr. | 225/94 |
| 2,269,052 | A | * | 1/1942 | Colvin | 30/120.3 |
| 2,298,528 | A | * | 10/1942 | De Causse | 225/2 |
| 2,765,532 | A | * | 10/1956 | Fruit | 30/254 |
| 3,565,309 | A | * | 2/1971 | Gross | 225/103 |
| 4,256,246 | A | * | 3/1981 | Kindel | 225/103 |
| 4,709,480 | A | * | 12/1987 | Takigawa et al. | 30/254 |
| 5,133,492 | A | * | 7/1992 | Wohrstein et al. | 225/2 |
| 5,274,319 | A | | 12/1993 | Keener et al. | |
| 5,398,857 | A | * | 3/1995 | Shinozaki et al. | 225/2 |
| 5,423,239 | A | | 6/1995 | Sakai et al. | |
| 5,423,240 | A | | 6/1995 | DeTorre | |
| 5,551,618 | A | * | 9/1996 | Shinozaki et al. | 225/96 |
| 5,794,500 | A | | 8/1998 | Long et al. | |
| 5,836,229 | A | * | 11/1998 | Wakayama et al. | 225/96 |
| 5,866,282 | A | | 2/1999 | Bourdelais et al. | |
| 5,974,922 | A | | 11/1999 | Camp et al. | |
| 6,043,009 | A | | 3/2000 | Bourdelais | |
| 6,820,784 | B1 | * | 11/2004 | Gao et al. | 225/20 |
| 2001/0052279 | A1 | * | 12/2001 | Sanda et al. | 83/500 |
| 2002/0017173 | A1 | * | 2/2002 | Li et al. | 83/13 |
| 2003/0129376 | A1 | * | 7/2003 | Lai et al. | 428/304.4 |
| 2003/0152760 | A1 | * | 8/2003 | Lai et al. | 428/314.4 |
| 2004/0074353 | A1 | * | 4/2004 | Van Dalen et al. | 83/13 |

OTHER PUBLICATIONS

"Friction, Wear, Lubrication, A Text Book in Tribology", K.C. Ludema, CRC Press, Inc. 1996.
"Fracture Mechanics, Fundamentals & Applications", T.L. Anderson, 1991, pp. 56-60.
"Finite element modeling of sheet-metal blanking operations with experimental verification", Ridha Hambli and Alain Potiron, *Journal of Materials Processing Technology 102,* pp. 257-265; Jan. 25, 2000.
* cited by examiner

*Primary Examiner*—Allan N. Shoap
*Assistant Examiner*—Jason Prone
(74) *Attorney, Agent, or Firm*—Mark G. Bocchetti; Paul A. Leipold

(57) ABSTRACT

A method and apparatus are taught for cutting a sheet material comprising the steps of engaging a first side of the laminated web structure with a crack initiator having a high rake angle, the crack initiator extending from a first cutter base having a low rake angle; simultaneously engaging a second side of the laminated web structure with a second cutter; generating a first crack in the first side of the laminated web structure with the crack initiator; generating a second crack in the second side of the laminated web structure with the second cutter; and propagating the first crack and the second crack to intersect. The crack initiator extends from a cutter base to a height of at least 5 μm. The high rake angle of the crack initiator is in the range of from about 30° to about 70°. The cutter base has a low rake angle that is at least about 15° less than the high rake angle of the crack initiator.

14 Claims, 3 Drawing Sheets

APPARATUS AND METHOD FOR CUTTING SHEET MATERIALS

CROSS-REFERENCE TO RELATED APPLICATIONS

The present application is related to U.S. Application filed same day herewith by Zhanjun Gao, et al and entitled, "A METHOD OF CUTTING A LAMINATED WEB AND REDUCING DELAMINATION".

FIELD OF THE INVENTION

The present invention relates generally to cutting apparatus and method for cutting sheet material and, more particularly, to cutting apparatus comprising opposed cutters for slitting and chopping sheet materials.

BACKGROUND OF THE INVENTION

Sheet materials, such as sheet papers, sheet metals, metal foils, polymeric sheets, polymeric films, sheet glass, sheet composites, multi-layered composite web, laminated web, and their associated forms with layers of organic or inorganic coatings, are often formed in long, wide sheets and then spooled into large rolls. These large, wide rolls must then be converted into predetermined sizes by slitting, chopping, and/or perforating. For most converting operations, as are also referred to as cutting operations, it is important that the cutting be performed without substantial cutting defects such as dust debris, hair debris, and delamination which might lead to a decrease in the value of the final products. To ensure high cut quality, it is often necessary to carefully design and select cutting tools based on the properties and structure of sheet material being cut. Furthermore, because tool wear often leads to poor cut quality, as well as extra costs resulting from machine down time and resharpening of the cutting tool, it is also important that the design and selection of cutting tools will ensure a long tool life.

Although various cutting devices employed in the converting of sheet materials may look very different from a macroscopic machine point of view, if examined at close proximity of the interaction of the cutters and sheet material, all cutting devices would look essentially the same as shown in FIG. 1 which presents a partial, sectional view of typical prior art knife cutting edge portions with sheet material therebetween. The major difference between various prior art cutting devices 10 (see FIG. 1), when examined in the scale of sheet material thickness, would be in the rake angles 12 and 14; relief angles 16 and 18; sharpness of edges 20, 22; clearance 24; material from which cutters 26, 28 are fabricated, and surface finish of cutters 26, 28. A multi-layered sheet material 30 is shown between cutters 26, 28. As depicted, multi-layered sheet material includes a support or base web 31, with an upper layer or coating 32 and a lower layer or coating 34. There is a planar interface 36 between upper layer or coating 32 and support or base web 31. There is a planar interface 38 between lower layer or coating 32 and support or base web 31.

Fundamentally, the cutting process is a fracture process. One needs to initiate and propagate a crack through the thickness of the sheet material. A clean cut usually requires good control of how the crack initiates and propagates throughout the cutting process. If the crack propagation is not well controlled, defects such as skiving, chipping, burr, dust, hair, cracking, and delamination can be generated from the adverse fracture behavior. The control for the cutting crack is especially important with the increasing use of layered sheet materials in photographic, optical, electronic, metal, and medical industries. With the multiple interfaces between sheets and/or layers in a multi-layered sheet material, a poorly controlled cutting crack tends to branch into one of the interfaces 36, 38 and create hair-like debris.

High rake cutters and low rake cutters are known in the prior art. From the mechanics viewpoint, the tip of the high rake cutter provides a high stress concentration in a very small region, which usually produces desired fracture without inducing undesired high stress in the surrounding material. Therefore, it tends to induce less defects. However, the tip of the high rake cutter itself is also subjected to a very high stress throughout the cutting process, which according to Archard's wear equation (*Friction, Wear, Lubrication, A Text Book in Tribology,* K. C. Ludema, CRC Press, Inc., 1996) has the disadvantage of a higher wear rate and a shorter tool life. The rake angle in the high rake cutter of prior arts typically is in the range of 45 to 70 degrees.

In contrast to the high-rake-angle cutter, a low rake angle cutter tends to spread the cutting pressure over a larger contact area on the sheet material and the cutter. Compared to the high rake cutting, because a larger area of the cut material is subjected to high stresses, more cutting defects such as debris and dust can be generated. However, because stress concentration at the cutter tip is smaller compared to the high rake cutter and once the crack begins to propagate, the cutter tip often is disengaged from contacting the sheet material, the tool life for low rake cutters tends to be longer. The rake angle in the high rake cutter of prior arts typically is in the range of 0 to 20 degrees.

Many cutters over the years have been devised to achieve high cut quality of sheet materials through the manipulation of the cutter geometries. U.S. Pat. No. 5,423,239 to Sakai and Takano discusses slitting a continuous running magnetic tape with a gap between blade edges of zero rake angle to prevent cutting defects. U.S. Pat. No. 5,974,922 to Camp et al. discusses the use of knives with rake angles between 50 and 70 degrees for color paper to achieve low cutting debris. U.S. Pat. No. 5,274,319 to Frye and Fitzpatrick discusses a combination of rake angles and penetration to slit high bulk traveling paper web with good slit quality. U.S. Pat. No. 5,794,500 to Long and White discusses an apparatus and method of slitting thin webs involving high rake knives similar to razor blades. U.S. Pat. No. 5,423,240 to Detorre discusses a side-crowned carbide cutting blades and devices for cutting tire cord fabric. None of these prior art cutters, however, are effective in generating a well-controlled cutting crack in sheet materials while achieving both high tool life and high cut quality.

SUMMARY OF THE INVENTION

It is therefore an object of the present invention to provide a method and apparatus for cutting laminated sheet materials that initiates and propagates a well-controlled crack.

It is a further object of the present invention to provide a method and apparatus for cutting sheet materials that produces a clean cut and enhanced tool life.

It is yet a further object of the present invention to provide a cutting tool for cutting sheet material that reduces cutting defects such as skiving, chipping, burr, dust, hair, cracking, and/or delamination.

Yet another object of the present invention is to provide a cutting tool for cutting sheet material that has enhanced tool life.

Briefly stated, these and numerous other features, objects and advantages of the present invention will become readily apparent upon a reading of the detailed description, claims and drawings set forth herein. These features, objects and advantages are accomplished by providing opposing cutters wherein at least one cutter comprises a high-rake-angle crack initiator and a low-rake-angle cutter base. Based on the mechanics analysis on the effect of rake angle, the present invention incorporates both the advantage of higher cut quality from the high rake cutter and longer tool life from the low rake cutter. This is achieved by providing a very localized high-rake-angle cutter tip referred to herein as the crack initiator on a low-rake-angle cutter base. The crack initiator is used to initiate the crack and drive the crack propagation over a certain distance. This distance can be determined by how sensitive the materials region is to the stress. For example, an interface between a coating or a laminate and a substrate is often such a region. To prevent delamination at this interface, it is desirable to reduce the stress at this interface. Therefore, the crack initiator is used to drive the crack past this interfacial region because the crack initiator confines the high stress concentration near the tip of the crack initiator without spreading the stress over to this stress-sensitive region. Once the crack has passed this stress-sensitive region, the low rake cutter base can come into more intimate contact with the sheet material being cut to take over the load previously carried by the crack initiator. From this point on, the crack propagation would be driven by the low rake cutter base and the crack initiator tip would gradually disengage from the sheet material. Since the crack initiator has minimal contact with the sheet material, the wear rate at the tip of the cutter is reduced, resulting in a longer tool life. Thus, with the combination of the high rake cutter tip and low rake cutter base, long tool life and high cut quality are achieved.

The cutting apparatus of the present invention for cutting sheet material includes a first cutter, including a crack initiator extending from a cutter base, the crack initiator having a high rake angle in the range of from about 30° to about 70°, the crack initiator having a relief angle in the range of from about 0° to about 30°, the cutter base having a low rake angle that is at least about 15° less than the high rake angle of the crack initiator, the cutter base having a relief angle in the range of from about 0° to about 30°, the crack initiator having a height of at least 5 μm; and a second cutter opposing the first cutter. This cutting apparatus allows for the practice of a method for cutting a web or sheet material comprising the steps of engaging a first side of the sheet material with a crack initiator having a high rake angle, the crack initiator extending from a first cutter base having a low rake angle; simultaneously engaging a second side of the sheet material with a second cutter; generating a first crack in the first side of the sheet material with the crack initiator; engaging the sheet material with the cutter base of the first cutter; further propagating the first crack using the cutter base; and disengaging the crack initiator of the first cutter. With the crack initiator thereby disengaged, the crack may be completed by propagating the crack through to the second side of the sheet material or generating a second crack in the second side of the sheet material with the second cutter and propagating the first cut to intersect with the crack propagating from the second cutter. This cutting apparatus further allows for the practice of a method for cutting a web or sheet structure comprising the steps of engaging a first side of the laminated web structure with a crack initiator having a high rake angle, the crack initiator extending from a first cutter having a low rake angle; simultaneously engaging a second side of the laminated web structure with a second cutter; generating a first crack in the first side of the laminated web structure with the crack initiator; generating a second crack in the second side of the laminated web structure with the second cutter; and propagating the first crack and the second crack to intersect.

DETAILED DESCRIPTION OF THE INVENTION

Figure 1:
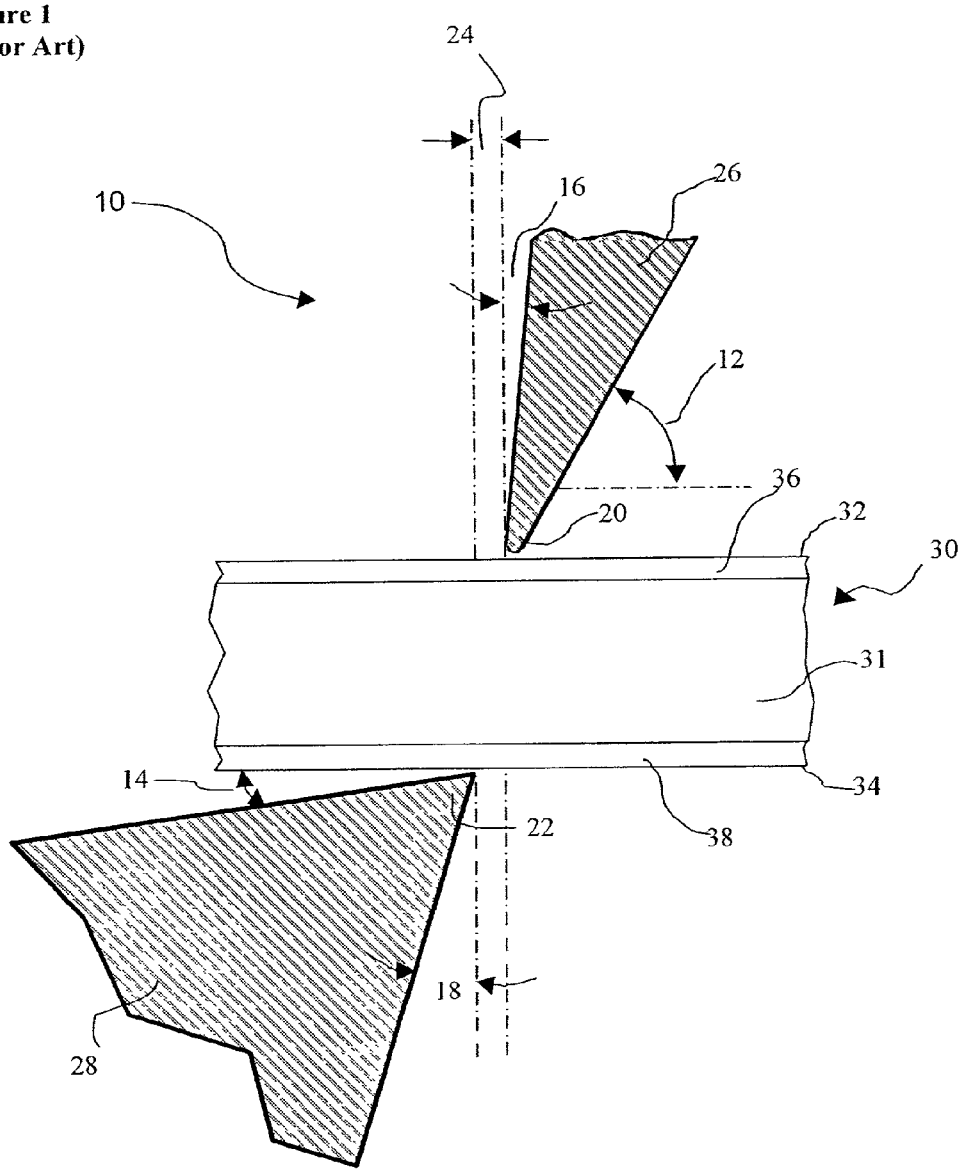
Figure 1 (Prior Art)
FIG. 1 is a partial sectional view illustrating the cutting edge portions of opposing prior art cutters with sheet material residing therebetween.
Figure 2:
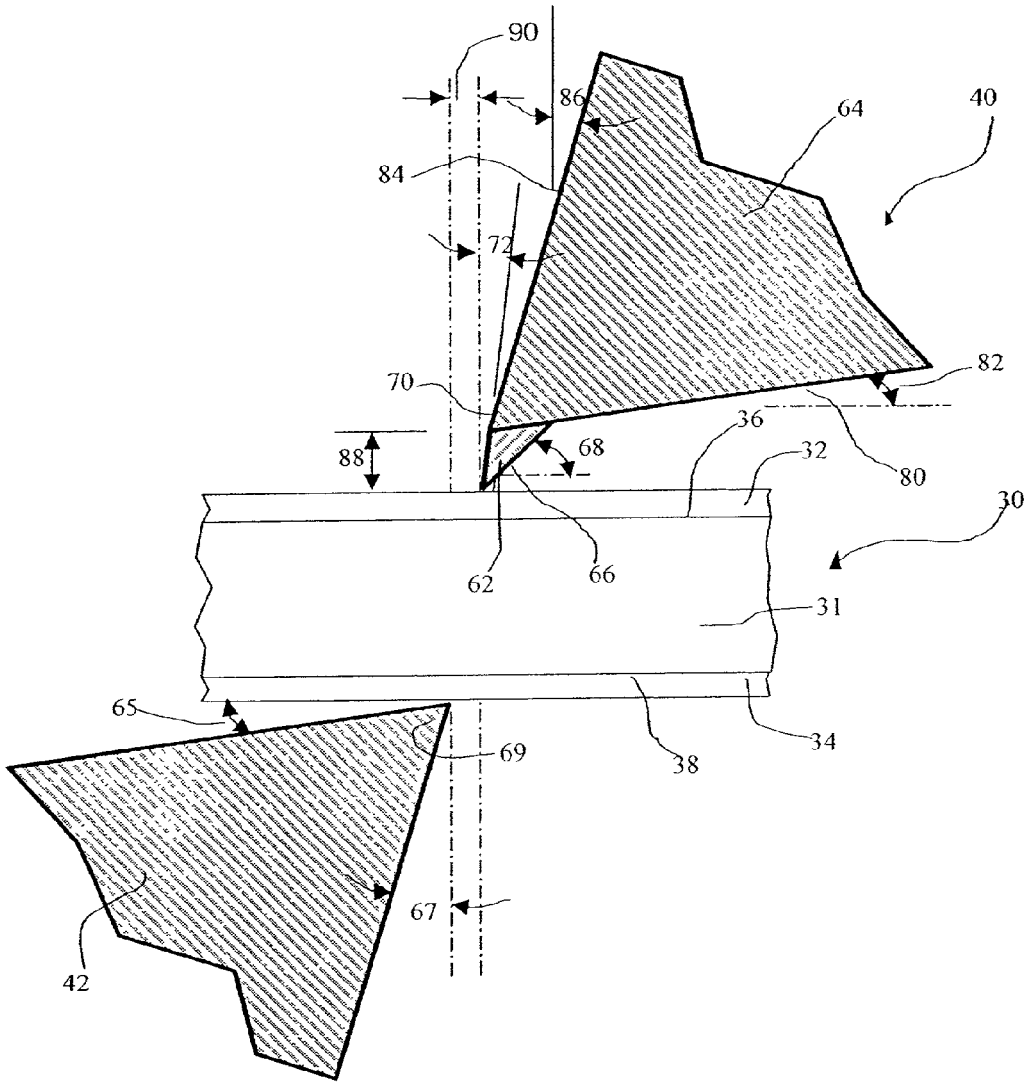
FIG. 2 is a partial sectional view illustrating the cutting edge portions of the opposing cutters of the present invention with sheet material residing therebetween wherein at least one of the cutters includes a crack initiator with a high rake angle extending from a cutter base having low rake angle.

Referring next to FIG. 2, there is illustrated a partial cross-sectional view of the cut edge portion of first and second opposing cutters 40, 42 with the same exemplary laminated sheet material depicted in FIG. 1. The first and second opposing cutters 40, 42 can be circular slitter knife blades, curve slitter knife blades, straight slitter knife blades, curve chopping knife blades, straight chopping knife blades, and scissors. The first cutter 40 includes a crack initiator 62 and a low rake cutter base 64. The crack initiator 62 further includes a rake edge 66 with a rake angle 68; and a relief edge 70 with a relief angle 72. The low rake cutter base 64 includes a rake edge 80 with a rake angle 82; and a relief edge 84 with a relief angle 86. The crack initiator 62 and low rake cutter base 64 can be made by a variety of methods including, for example, electric discharge machining, chemical etch, grinding, milling, molding, lapping, assembling two separate pieces of material, honing or burnishing. The main functions of the crack initiator 62 are to initiate and propagate a crack until the base rake edge 80 contacts the sheet material 30 and begins to drive the cutting process. Specifically, the crack initiator 62 is used to penetrate through the upper coating or laminate 32 and into the base web 31 while keeping the stress in the sheet material 30 concentrated around the crack initiator 62 rather than spreading the high stress outside this confined zone and into a larger area. With this highly concentrated stress zone, the stress seen by the material or regions sensitive to stress, specifically the planar interface 36, is reduced. Reducing the stress at the planar interface 36 reduces the damage thereto resulting in reduced cutting defects. The function of the cutter base 64 is to continue the cutting process after the rake edge 80 of the cutter base 64 comes into contact with the sheet material 30 by taking over the cutting force from the crack initiator 62. As the cutter base 64 takes over the cutting force, it can protect the crack initiator 62 from further high stress contact of the sheet material 30 thereby resulting in a longer life of the crack initiator 62 and an overall longer tool life.

Second opposing cutter 42 is substantially identical to the prior art cutter 28 depicted in FIG. 1. Therefore, rake angle 65, relief angle 67 and the sharpness of edge 69 are substantially identical to rake angle 14, relief angle 18 and the sharpness of edge 22. The first and second cutters are separated by a clearance 90.

65, relief angle 67 and the sharpness of edge 69 are substantially identical to rake angle 14, relief angle 18 and the sharpness of edge 22. The first and second cutters are separated by a clearance 90.

To achieve the functions described above, the crack initiator 62 should have a rake angle 68 in the range between 30° and 70°, preferably between about 40° and 70°, and most preferably between about 45° and 70°, and a relief angle 72 larger than 0° and smaller than about 30°. Although shown in FIG. 2 as straight, the rake edge 66 and relief edge 70 of the crack initiator can be slightly curved. The initiator height 88 of the crack initiator 62 depends on the depth of where the stress sensitive region in the cut material is located. The range of the initiator height 88 may be from about 5 μm to the about thickness of the sheet material. Preferably, the initiator height is at least 15 μm and, most preferably, the initiator height is at least 20 μm. The relief angle 86 of the cutter base 64 is in the range from −30° to 30° from vertical with respect to the plane of the web. Preferably, the relief angle 86 of the cutter base 64 is in the range from 0° to 30°. The rake angle 82 of the cutter base 64 should be at least about 15° less than the angle 68 and is preferably at least about 20° less than angle 68. The rake edge 80 of the cutter base 64 can be slightly curved. The intersection between the base rake edge 80 and initiator rake edge 66 can have a distinct angle or simply a smooth curved transition.

EXAMPLES

Nine examples to evaluate the cutting performance of three cutting tools, including the cutting tool of the present invention, are given in this section. The technique used in the evaluation is the computational finite element method. The nine examples consist of three different sheet materials subjected to three different knife setups. The sheet material thickness and material are listed in Table 1 below:

TABLE 1

| Sheet Material # | Coating Material | Coating Thickness (in) | Support Material | Support Thickness (in) | Total Thickness (in) |
|---|---|---|---|---|---|
| 1 | Gelatin Emulsion | 0.0007 | CTA | 0.0047 | 0.0054 |
| 2 | Gelatin Emulsion | 0.0007 | PEN | 0.0047 | 0.0054 |
| 3 | Gelatin Emulsion | 0.0007 | PET | 0.0047 | 0.0054 |

The coating material is a common gelatin based photographic emulsion coating. There are three different types of support web for the emulsion: cellulous triacetate (CTA); poly(ethylene 2,6-naphthalate) (PEN); and poly(ethylene terephthalate) (PET). CTA represents a relative brittle polymer for its 35% of elongation to break in a tensile test according to ASTM D638. PEN represents a moderately ductile polymer for a 60% of elongation to break. PET represents a relatively ductile polymer for a 115% of elongation to break. All three base web or support materials have been extensively used in the photographic industry. In all cases, the coating layer faces the upper knife. The knife setups are listed in the Table 2 below:

TABLE 2

| | Upper Knife | | | | | | Lower Knife | | | |
|---|---|---|---|---|---|---|---|---|---|---|
| | Initiator | | Cutter Base | | | | | | | |
| Knife Setup # | Relief Angle (degrees) | Initiator Rake Angle (degrees) | Initiator Height (in) | Relief Angle (degrees) | Cutter Base Relief Angle (degrees) | Tip radius (in) | Relief Angle (degrees) | Rake Angle (degrees) | Tip radius (in) | Clearance (in) |
| 1 (prior art) | N/A | N/A | N/A | 0 | 0 | 0.0001 | 0 | 0 | 0.0003 | 0.0006 |
| 2 (prior art) | N/A | N/A | N/A | 0 | 60 | 0.0001 | 0 | 0 | 0.0003 | 0.0006 |
| 3 | 0 | 60 | 0.0013 | 0 | 0 | 0.0001 | 0 | 0 | 0.0003 | 0.0006 |

N/A - not applicable

Knife setups 1 and 2 are the prior art setups typical of what is used in a slitting operation in the photographic industry. Note that the tip radius of the lower knife is larger than the upper knife, which is often the case because the upper knife is usually reground more often. Nine examples are obtained from the combination of three sheet materials and three knife setups. They are listed in Table 3 below:

TABLE 3

| Example # | Sheet Material # | Knife Setup # |
|---|---|---|
| 1 | 1 | 1 |
| 2 | 1 | 2 |
| 3 | 1 | 3 |
| 4 | 2 | 1 |
| 5 | 2 | 2 |
| 6 | 2 | 3 |
| 7 | 3 | 1 |
| 8 | 3 | 2 |
| 9 | 3 | 3 |

In accordance with conventional finite element analysis techniques, the first step of the analysis is to generate a geometric representation of the entire knife blade structure and sheet material, including all the layers. A geometric model of the sheet material is created by dividing all sheet material into discrete elements (also called mesh). The knives are modeled as rigid surfaces since typical knives are made of material much stiffer and more massive than materials for the sheet material. A pair of typical knives is modeled. Practical cutting operations utilize one knife that is moving relative to the other. Therefore, we model one knife as stationary and the other as moving. In this example, the upper knife is modeled as the moving knife and the lower knife is modeled as the stationary knife. Furthermore, the sheet material to be cut is usually stationary relative to the moving knife. Therefore, we model the sheet material so that it rests on top of the stationary knife. Each layer of the sheet material is modeled as an elastic/plastic material with a work hardening and a break of elongation value. To determine the material properties, the following procedure is used.

First we run a cutting experiment with a pair of moving and stationary blades of zero rake angle, zero relief angle, knife tip radius of 0.00015 inch, and a clearance of 0.0003 inch. The setup can be mounted on an instrument that has a load cell and displacement read-out such as an Instron™ universal tester and a data requisition system. We then mount the sample of mono-layered material in the cutting setup. Once the cutting of samples is completed, the cutting force and moving knife displacement data can be obtained and a curve of cutting force versus knife displacement can be established. A typical cutting curve can be found in the article by Hambli and Potiron (Hambli R. and Potiron A. "Finite element model of sheet-metal blanking operations with experimental verification" Journal of Material Processing Technology, 2000, pp. 257–265.), which resembles the stress-strain curve from the simple tensile test. The cutting curve can be used to help determine the elastic modulus, yield strength, break strength, and break elongation in the numerical calibration procedure described below.

Based on the test setup, an equivalent finite element model can be constructed. Using this model and cutting curve as guideline, we can iteratively adjust the elastic modulus, yield strength, break strength, and break elongation for the modeled material and eventually obtain a cutting curve comparable to the experimental one. Once a good fit between the two cutting curves is found, the material properties are determined and used in the subsequent simulation.

To evaluate the cut quality in the nine examples described above, we use the crack length in the coating layer along the interface on the stationary knife side as an index. This location is also where most cutting defects are found either as hair, dust, or as coating delamination in the slitting and chopping of photographic material. Note that the crack length is related to the stress level along the interface between the coating and support. The evaluation is based on the rule that the longer the crack length, the higher the stress level, and the worse the cut quality. For comparison purpose, the crack length is normalized with respect to the crack length in the cases with knife setup #1 within the same sheet material group. Specifically, the "normalized crack length" is obtained by normalizing the crack length of Examples 1–3 with respect to Example 1; Examples 4–6 with respect to Example 4; and Examples 7–9 with respect to Example 7. Note that the knife setup #1 in Example 1, 4, and 7 typically produces the longest crack length and is expected to produce the lowest cut quality.

According to Archard's wear equation, the material wear is proportional to the contact stress and sliding distance between the two materials in contact. A simple way to evaluate the tool life performance based on the Archard's equation and finite element analysis, is to measure the sliding distance between the knife tip and sheet material during the cutting process: the shorter the sliding distance, the longer the tool life. In this study, the sliding distance is determined by the travel distance of the upper knife from the time the upper knife contacts the sheet material to the time when the upper knife tip disengages from the sheet material. For comparison purpose, we also normalize the sliding distance with respect to the crack length in the cases with knife setup #2 within the same sheet material group. Specifically, the "normalized sliding distance" is obtained by normalizing the sliding distance of Examples 1–3 with respect to Example 2; Examples 4–6 with respect to Example 5; and Examples 7–9 with respect to Example 8. It is found that Examples 2, 5, and 8 have the longest normalized sliding distance and therefore, are expected to have the shortest tool life.

Table 4 illustrates the result of tool life and cut quality evaluation of the nine examples. Scores are assigned to each performance category, with 3 being excellent, 2 being good, and 1 being mediocre. The results show that the cut quality performance of the current invention is mostly excellent. It is very comparable to the knife setup #2 which generally produces the best cut quality but a relatively poor tool life. The tool life performance of the current invention is mostly considered to be good, which performs more similarly to the knife setup #1. The total score suggests that the performance of current invention has the best overall performance among the three knife setups investigated.

TABLE 4

| | | | Tool Wear | | Cut Quality | | |
|---|---|---|---|---|---|---|---|
| Example # | Sheet Material # | Knife Setup # | Normalized Sliding Distance * | Score | Normalized Crack Length ** | Score | Total Score |
| 1 | 1 | 1 (prior art) | 0.54 | 3 | 1.00 | 1 | 4 |
| 2 | 1 | 2 (prior art) | 1.00 | 1 | 0.00 | 3 | 4 |
| 3 | 1 | 3 | 0.68 | 2 | 0.07 | 3 | 5 |
| 4 | 2 | 1 (prior art) | 0.56 | 3 | 1.00 | 1 | 4 |
| 5 | 2 | 2 (prior art) | 1.00 | 1 | 0.00 | 3 | 4 |
| 6 | 2 | 3 | 0.71 | 2 | 0.00 | 3 | 5 |
| 7 | 3 | 1 (prior art) | 0.67 | 3 | 1.00 | 1 | 4 |
| 8 | 3 | 2 (prior art) | 1.00 | 1 | 0.38 | 3 | 4 |
| 9 | 3 | 3 | 0.82 | 2 | 0.75 | 2 | 4 |

* Obtained by normalizing the sliding distance of Examples 1-3 with respect to Example 2; Examples 4-6 with respect to Example 5; and Examples 7-9 with respect to Example 8.
** Obtained by normalizing the crack length of Examples 1-3 with respect to Example 1; Examples 4-6 with respect to Example 4; and Examples 7-9 with respect to Example 7.

From this result, it can be seen that this invention can result in less cutting debris than a conventional low rake angle cutter and have a longer tool life than a conventional high rake angle cutter. The sheet materials with which the cutter of the present invention can be used include plastic, metals, glass, paper, composites, and multi-layered materials. For the purpose of this invention, the term "multi-layered" is intended to include web structures having a base web or sheet plus one or more coatings applied thereto and/or one or more laminated sheets affixed thereto.

Figure 3:
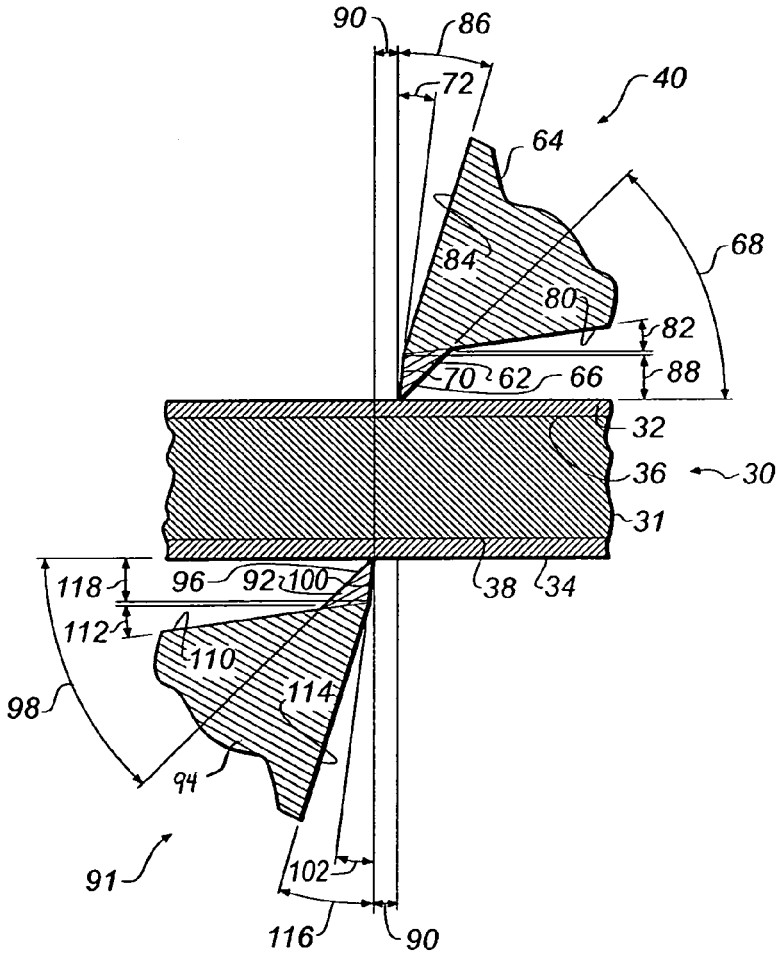
FIG. 3 is a partial sectional view illustrating the cuffing edge portions of the opposing cutters of the present invention with sheet material residing there between wherein each of the cutters includes a crack initiator with a high rake angle extending from a cutter base having low rake angle.

Although FIG. 2 shows a first cutter 40 with a crack initiator 62 being used in conjunction with a second cutter 42 that is a typical prior art cutter, it will be appreciated by those skilled in the art that second cutter 42 can be replaced with a cutter that is similar or identical to first cutter 40. That is, second cutter 42 can include a crack initiator as well with rake and relief angles as discussed with reference to cutter base 64 and crack initiator 62. Such an arrangement is depicted in FIG. 3 where there is illustrated a partial cross-sectional view of the cut edge portion of first and second opposing cutters 40, 91 with the same exemplary laminated sheet material depicted in FIG. 1. The first and second opposing cutters 40, 91 can be circular slitter knife blades, curve slitter knife blades, straight slitter knife blades, curve chopping knife blades, straight chopping knife blades, and scissors. First cutter 40 is identical to first cutter 40 depicted and described with reference to FIG. 2. The second cutter 91 also includes a crack initiator 92 (having a height 118) and a low rake cutter base. The crack initiator 92 further includes a rake edge 96 with a rake angle 98; and a relief edge 100 with a relief angle 102. The low rake cutter base 94 includes a rake edge 110 with a rake angle 112; and a relief edge 114 with a relief angle 116. The crack initiator 92 and can be made by a variety of methods including, for example, electric discharge machining, chemical etch, grinding, milling, molding, lapping, assembling two separate pieces of material, honing or burnishing. The main functions of the crack initiator 92 are to initiate and propagate a crack until the base rake edge 110 contacts the sheet material 30 and begins to drive the cutting process. Specifically, the crack initiator 92 is used to penetrate through the upper coating or laminate 32 and into the base web 31 while keeping the stress in the sheet material 30 concentrated around the crack initiator 62 rather than spreading the high stress outside this confined zone and into a larger area. With this highly concentrated stress zone, the stress seen by the material or regions sensitive to stress, specifically the planar interface 36, is reduced. Reducing the stress at the planar interface 36 reduces the damage thereto resulting in reduced cutting defects. The function of the cutter base 94 is to continue the cutting process after the rake edge 110 of the cutter base 64 comes into contact with the sheet material 30 by taking over the cutting force from the crack initiator 92. As the cutter base 94 takes over the cutting force, it can protect the crack initiator 92 from further high stress contact of the sheet material 30 thereby resulting in a longer life of the crack initiator 92 and an overall longer tool life.

From the foregoing, it will be seen that this invention is one well adapted to attain all of the ends and objects herein above set forth together with other advantages which are apparent and which are inherent to the process.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth and shown in the accompanying drawings is to be interpreted as illustrative and not in a limiting sense.

PARTS LIST

10 prior art cutting devices
12 rake angles
14 rake angles
16 relief angles
18 relief angles
20 sharpness of edges
22 sharpness of edges
24 clearance
26 cutters
28 cutters
30 sheet material
31 support or base web
32 upper layer or coating
34 lower layer or coating
36 planar interface
38 planar interface
40 $1^{st}$ opposing cutters
42 $2^{nd}$ opposing cutters
62 crack initiator
64 low rake cutter base
65 rake angle
66 rake edge
67 relief angle
68 rake angle
69 sharpness of edge
70 relief edge
72 relief angle
80 rake edge
82 rake angle
84 relief edge
86 relief angle
88 initiator height
90 clearance
91 opposing cutter
92 crack initiator
94 low rake cutter base
96 rake edge
98 rake angle
100 relief edge
102 relief angle
104 low rake cutter base
110 rake edge
112 rake angle
114 relief edge
116 relief angle
118 height

What is claimed is:

1. A method of cutting sheet material comprising the steps of:

(a) engaging a first side of the sheet material with a first crack initiator having a high rake angle, the crack initiator extending from a first cutter base having a low rake angle;

(b) simultaneously engaging a second side of the sheet material with a second cutter;

(c) generating a first crack in the first side of the sheet material with the first crack initiator;

(d) engaging the sheet material with the cutter base of the first cutter by moving the first cutter perpendicular to the sheet material; and (e) further propagating the first crack using a rake edge of the cutter base, thereby disengaging the first crack initiator of the first cutter from contact with the sheet material, the sheet material comprises a laminated web structure and the first crack initiator has a height that is greater than a thickness of a protective laminate or coating on the first side of the laminated web structure.

2. A method as recited in claim 1 further comprising the step of:

continuing to propagate the crack through to the second side of the sheet material using a rake edge of the cutter base.

3. A method as recited in claim 1 further comprising the step of:

(a) generating a second crack in the second side of the sheet material with the second cutter; and (b) propagating the first crack to intersect with the crack propagating from the second cutter.

4. A method as recited in claim 1 wherein:

said laminated web structure comprises a protective coating on the first side of the laminated web structure at least 15 μm thick.

5. A method as recited in claim 1 wherein:

said laminated web structure comprises a protective coating on the first side of the laminated web structure at least 20 μm thick.

6. A method as recited in claim 1 wherein:

the second cutter includes a second crack initiator extending from a second cutter base.

7. A method as recited in claim 6 wherein:

the second crack initiator has a height that is greater than a thickness of a laminate or protective coating on the second side of the laminated web structure.

8. A method as recited in claim 6 wherein:

the high rake angle of the second crack initiator is in the range of from about 30° to about 70°.

9. A method as recited in claim 1 wherein:

the high rake angle of the first crack initiator is in the range of from about 30° to about 70°.

10. A method as recited in claim 9 wherein:

the low rake angle of the cutter base of the first cutter is at least about 15° less than the high rake angle of the crack initiator.

11. A method as recited in claim 10 wherein:

the crack initiator has a relief angle greater than 0° and not more than about 30°.

12. A method as recited in claim 11 wherein:

the cutter base of the first cutter has a relief angle of not more than about 30°.

13. A method as recited in claim 9 wherein:

the high rake angle of the crack initiator is not less than about 40°.

14. A method as recited in claim 13 wherein:

the high rake angle of the crack initiator is not less than about 45°.

* * * * *